US009327864B2

(12) United States Patent
Bell et al.

(10) Patent No.: US 9,327,864 B2
(45) Date of Patent: May 3, 2016

(54) PAPERBOARD CARTON WITH FOLDABLE CONDIMENT HOLDER AND A BLANK THEREFOR

(71) Applicant: Huhtamaki, Inc., De Soto, KS (US)

(72) Inventors: Phillip M. Bell, Overland Park, KS (US); Ronald D. Robertson, Kansas City, MO (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 14/548,042

(22) Filed: Nov. 19, 2014

(65) Prior Publication Data

US 2015/0136843 A1 May 21, 2015

Related U.S. Application Data

(60) Provisional application No. 61/906,312, filed on Nov. 19, 2013.

(51) Int. Cl.
*B65D 5/48* (2006.01)
*B65D 5/50* (2006.01)

(52) U.S. Cl.
CPC ..... *B65D 5/5021* (2013.01); *B65D 5/4801* (2013.01)

(58) Field of Classification Search
USPC ..... 229/120.21, 904
See application file for complete search history.

(56) References Cited

U.S. PATENT DOCUMENTS 2,924,372 A * 2/1960 Kirkeby ..... 206/563
4,757,937 A * 7/1988 Maio et al. ..... 229/117.07
7,980,454 B2 * 7/2011 Burton et al. ..... 229/120.18

* cited by examiner

*Primary Examiner* — Christopher Demeree
(74) *Attorney, Agent, or Firm* — Husch Blackwell LLP

(57) ABSTRACT

A foldable food carton including a collapsible condiment container holder is provided. The food carton may be constructed from a single blank and is capable of being folded into a substantially flat configuration for transportation or storage. The condiment container holder is designed go from a collapsed position, where it is folded substantially flat against the sidewall panel of the carton, to an extended position, where it is capable of holding a single-serving condiment container in close proximity to the carton. The condiment container may consist of a holding section hingedly connected to a sidewall panel of the carton and a support leg hingedly connected to the holding section and capable of supporting the holding section when it is extended horizontally from the sidewall panel. The holding section can include an opening with tabs therein in order to receive and secure a condiment container for use with the carton.

19 Claims, 6 Drawing Sheets

PAPERBOARD CARTON WITH FOLDABLE CONDIMENT HOLDER AND A BLANK THEREFOR

CROSS-REFERENCE TO RELATED APPLICATIONS

This Application claims priority to U.S. Provisional Patent Application Ser. No. 61/906,312, filed on Nov. 19, 2013, to Phillip M. Bell, et al. entitled "Paperboard Carton with Foldable Condiment Holder and a Blank Therefor," the entire disclosure of which is incorporated herein by reference.

BACKGROUND

Fast-food and takeout restaurants serve food items that are commonly eaten along with a sauce or condiment such as ketchup, mustard, mayonnaise, barbecue sauce, honey, dressings, cheeses, butter, syrups, jellies and other condiments. Whether intended to be eaten at the restaurant or taken to go, these food items are often served in a paperboard carton.

Condiments are often packaged in various types of single-serving condiment containers. One common type of condiment container is comprised of a plastic body and a cover. The cover is commonly secured to the plastic body by an adhesive. In order to access the condiment, the cover is either pulled back or all the way off to expose the condiment. The food items may then be dipped in the condiment. For convenience, and in order to prevent dripping of the condiment onto the surface on which the carton is resting (e.g., table or vehicle console), it is desirable to place the condiment container in close proximity to the food items. Securing the condiment container to the carton in which the food items are served guarantees that the food items and condiment are in close proximity.

Some cartons in which food items are served may be folded flat for transportation and storage prior to use. This reduces the amount of space taken up by the cartons prior to use, thereby reducing shipping and storage costs.

Accordingly, a need exists for a carton, particularly one having a box structure, which includes a means for securing a condiment container to the carton. A need also exists for such a carton that can be folded flat for shipping and storage.

SUMMARY OF THE INVENTION

The objective of the present invention is to provide a food carton that includes a collapsible holder for receiving a condiment or sauce container. A further objective of the present invention is to provide a food carton with a condiment container holder that is capable of being folded into a substantially flat configuration for storage and transportation. Yet another objective of the present invention is to provide a food carton with a condiment container holder that can be constructed from a unitary blank of material.

In one embodiment of the present invention, a food carton comprising a lid portion, body portion, and condiment container holding portion is constructed from a blank that may be cut from a single sheet of material. The condiment container holder is connected to a sidewall panel of the body portion along its upper edge by a fold line or score line. The condiment container holder can comprise a holding section and support leg, wherein the holding section is hingedly connected to the sidewall panel and the support leg is hingedly connected to the holding section.

The condiment container holder may be constructed such that it is capable of being in both a collapsed position and an extended position. In the collapsed position, the support leg can be folded flat against the holding section and the holding section can be folded flat against the sidewall panel. In the collapsed position, the condiment container holder preferably does not block any access to the inside of the carton. The collapsible configuration of the condiment container holder also allows the carton to be folded into a substantially flat configuration for more efficient storage and transportation. When the condiment container holder is in the extended position, the holding section is extended generally horizontally outward from the upper edge of the carton sidewall panel and the support leg may be extended generally downward in order to support the holding section. The hinge connection between the carton sidewall panel and the condiment container holder allows for the condiment container holder to be extended either inside or outside of the carton body portion.

In one embodiment, the holding section includes an opening that is capable for receiving a single-serving condiment container. The opening may include a plurality of deformable tabs extending inwardly from the edge of the opening in order to provide an interference fit with the condiment container. The support leg can comprise a center web and support flanges that are folded inwardly, or outwardly, in order to strengthen the support leg while the condiment container holder is in use.

Other aspects and advantages of the present invention will be apparent from the following detailed description of the preferred embodiments and the accompanying drawing figures.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
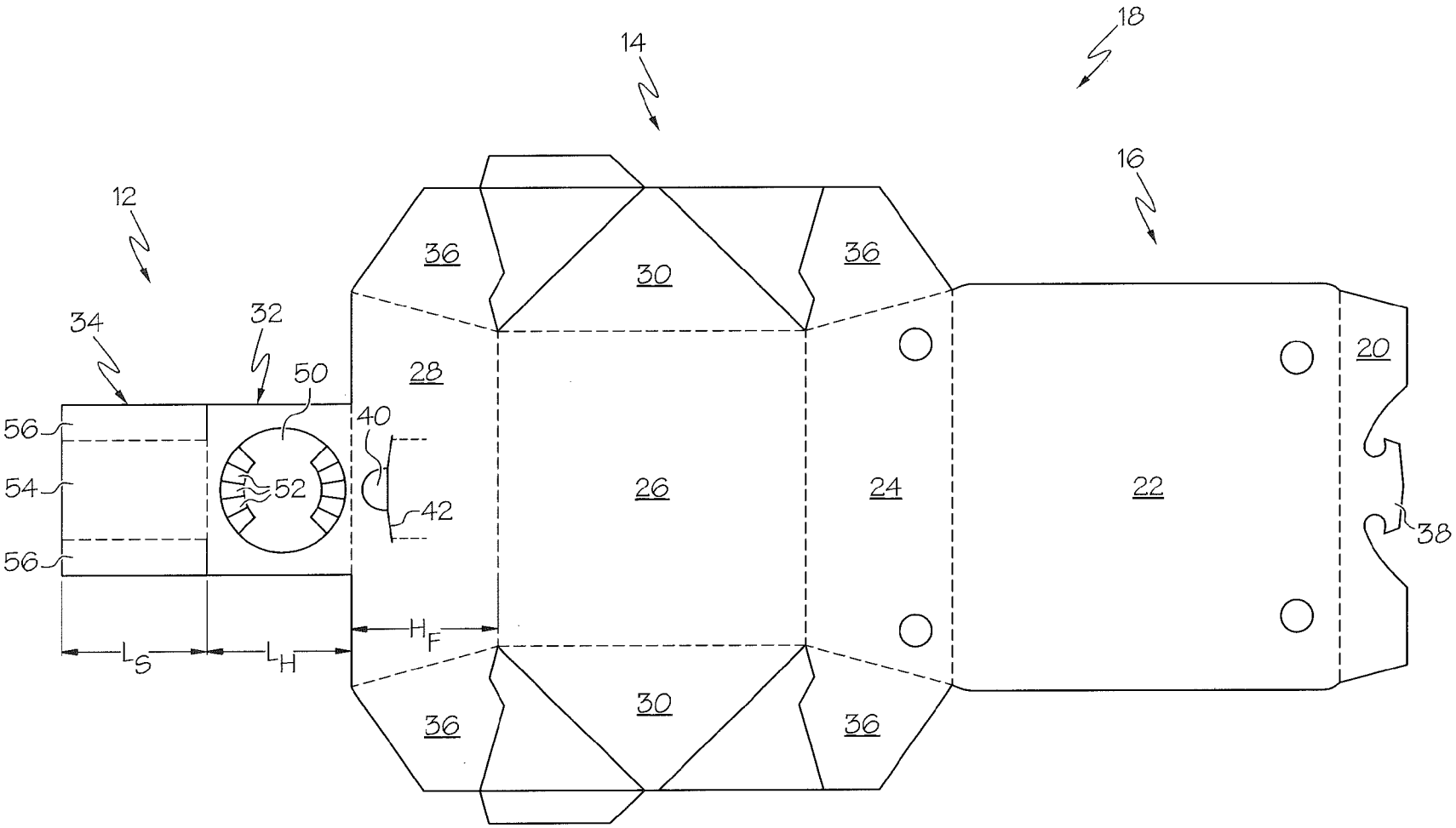
FIG. 1 is a plan view of a blank from which a carton having a foldable condiment container holder may be formed in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a carton 10 having a foldable sauce or condiment container holder 12 that may be selectively arranged between a collapsed, or closed, position and an extended, or open, position depending upon the user's preference. In addition to condiment container holder 12, carton 10 includes a base portion 14, and a lid portion 16. As discussed in greater detail below, the foldable condiment container holder 12 may be folded so that the entire carton 10 can be folded into a substantially flat configuration for transportation and storage prior to use.

Referring to FIG. 1, carton 10 can be formed from a flat blank 18 that may be constructed of paperboard or other suitable material. One or both sides of the paperboard may have a coating and/or graphics applied thereto. Blank 18 may comprise a single unitary piece of material cut from a larger sheet or roll of material in a die-stamping process, for example. Blank 18 may also comprise of separate pieces, such as a lid portion, body portion, and condiment container holder portion, which are combined and attached together through common methods.

In one embodiment, blank 18 has nine main panels including a cover panel 20, a top panel 22, a rear panel 24, a bottom panel 26, a front panel 28, two side panels 30, a holding section 32 and a support leg 34. Blank 18 can also include flaps 36 connected to the side panels 30 so that the base portion 14 can be formed into a box. Holding section 32 and support leg 34 combine to create the condiment container holder 12 of carton 10. The panels 20, 22, 24, 26, 28, 30, 32 and 34 and flaps 36 may be hingedly connected to one another by fold lines or score lines, as shown by broken lines in FIGS. 1 and 2. Some or all of the score lines may be perforated to assist in the folding of the blank 18 into the finished carton 10. The panels and fold lines of blank 18 are arranged such that the entire carton 10 may be folded into a substantially flat configuration.

In one embodiment, cover panel 20 includes a locking tab or latch 38 formed therein or protruding therefrom. In the same embodiment, front panel 28 may include a corresponding slot 40 and slits 42 defined therein and configured to be engaged by the locking tab 38 of cover panel 20 for maintaining carton 10 in a closed orientation.

Figure 2:
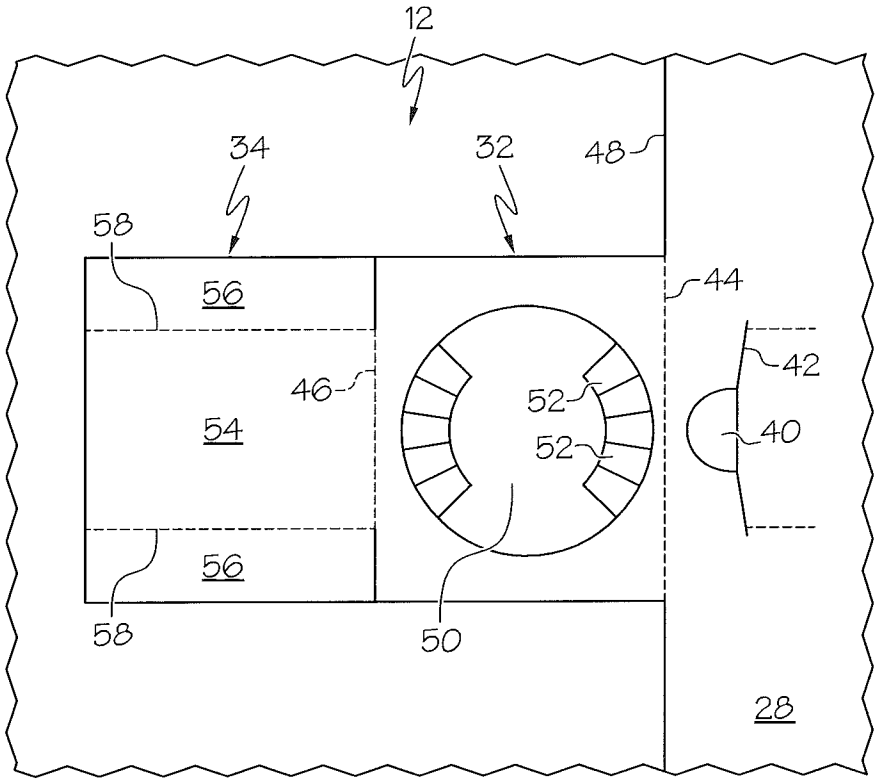
FIG. 2 is an enlarged plan view of the condiment container holder of the blank of FIG. 1 in accordance with one embodiment of the present invention.
Figure 3:
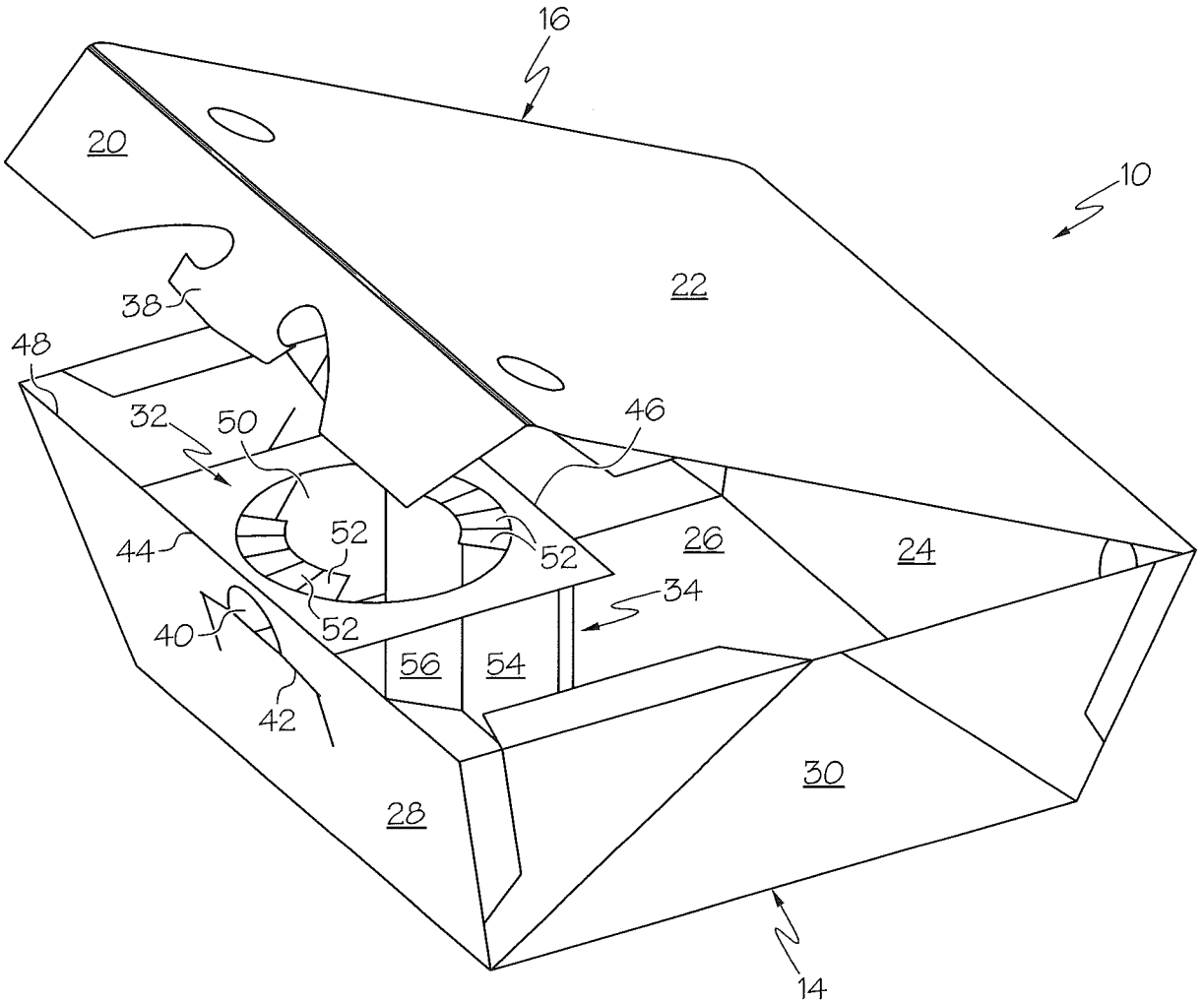
FIG. 3 is a top perspective view of a carton configured from the blank of FIG. 1 in accordance with one embodiment of the present invention.

As illustrated in the figures, condiment container holder 12 is connected to one of the plurality of sidewalls of base portion 14. As shown in FIG. 2, condiment container holder 12 may be connected to front panel 28 along the upper edge 48 of front panel 28. However, condiment container holder 12 may also be connected to another sidewall of the base portion 14, such as one of the side panels 30. Condiment container holder 12 may be connected at any point along the upper edge of the sidewall panel of base portion 14. FIGS. 3-6 show condiment container holder 12 located generally along the middle portion of the front panel's 28 upper edge 48. In another embodiment, condiment container 12 may be positioned such that it is off-center with respect to the sidewall panel and located more near one of the respective corners of carton 10. The connection between condiment container holder 12 and the sidewall of base portion 14 may be formed by a fold line or score line, similar to the other hinge connections of carton 10. Condiment container holder 12 may also be detachable from the carton sidewall, such as by using an interlocking tab and slot configuration or a perforated fold line.

In one embodiment, condiment container holder 12 comprises a holding section 32 and a support leg 34. The holding section 32 is of a generally rectangular shape and includes a first end 44 and second end 46. Holding section 32 may also take on any number of different shapes that permit holding section 32 to be folded flat against the carton sidewall panel when in the closed position. First end 44 is hingedly connected to the upper edge of the carton sidewall panel in order to connect condiment container holder 12 to the remainder of carton 10. FIGS. 3-6 show one embodiment where the first end 44 of holding section 32 is connected to the upper edge 48 of front panel 28. However, first end 44 of holding section 32 may also be connected to the upper edge of one of side panels 30 of base portion 14. The figures show an embodiment where first end 44 is fully connected to the upper edge 48 of front panel 28. However, it is understood that the first end 44 may be only partially connected to the upper edge 48 of front panel 28, or only partially connected to the upper edge of one of side panels 30.

Figure 5:
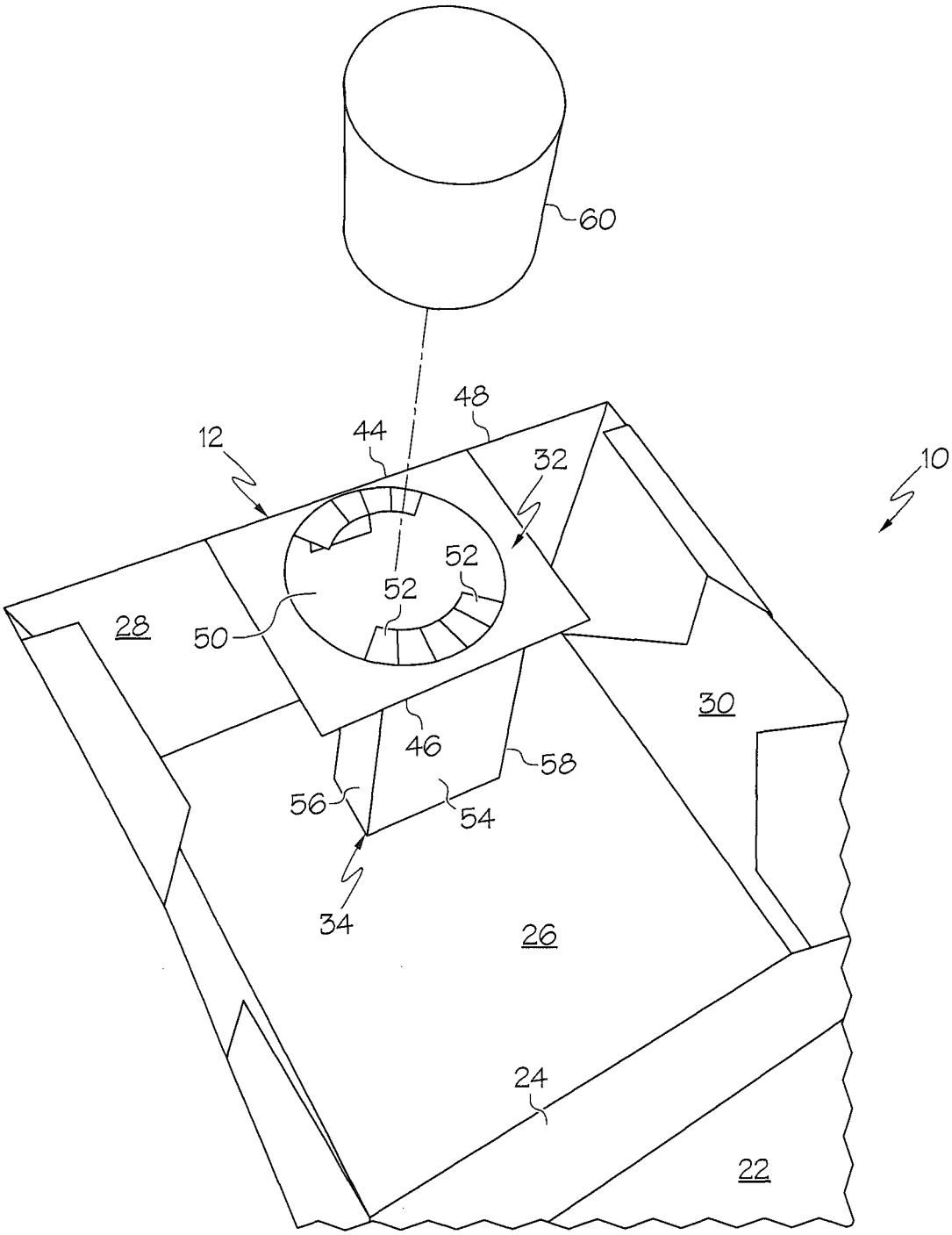
FIG. 5 is a partial top perspective view of the configured carton of FIG. 3 illustrating the condiment container holder in an inwardly-extended serving position inside the carton in accordance with one embodiment of the present invention.

When in the open or extending position, holding section 32 may extend generally horizontally away from the carton sidewall panel. Due to the folded connection between holding section 32 and the carton sidewall upper edge, condiment container holder 12 may be located either inside carton 10 or outside carton 10 when in the open or extended position. FIG. 5 shows condiment container holder 12 located inside carton 10, while FIG. 6 shows condiment container holder 12 located outside carton 10 when it is in the open or extended position.

Holding section 32 also has an opening 50 defined therethrough that is suitable for receiving a single-serving sauce or condiment container 60. A condiment container 60 may be inserted and held in the opening 50 when condiment container holder 12 is in an open or extended position, as shown in FIGS. 2, 5 and 6. Opening 50 may be sized and shaped to receive a one or more of a variety of condiment containers 60 of various shapes (e.g., round, rectangular, square, oval, trapezoidal, etc.) that may be distributed by different vendors. In one embodiment, the condiment container 60 may have a generally frustoconical or tapered sidewall portion. Opening 50 may be sized and shaped so that an upper outwardly extending flange (not shown) or rim of the condiment container 60 sits on the holding section 32 when the condiment container is fully inserted into the opening 50. The opening 50 may include a plurality of deformable fingers or tabs 52 extending inwardly from the periphery of the opening 50. The tabs 52 are designed to provide an interference fit and a gripping force against the sidewall of the condiment container. The tabs 52 can be deflected downwardly when a condiment container is placed in the opening 50. In an alternative embodiment, opening 50 may include only a single tab protruding inwardly from its periphery that assists in keeping a condiment container in opening 50. As shown in FIG. 2, opening 50 is located in the general center of holding section 32. However, opening 50 may be placed anywhere on holding section 32, such as closer to the first end 44 of holding section 32 in order to provide more structural rigidity. Holding section 32 may also be sized such that it may contain multiple openings for receiving multiple condiment containers.

Figure 6:
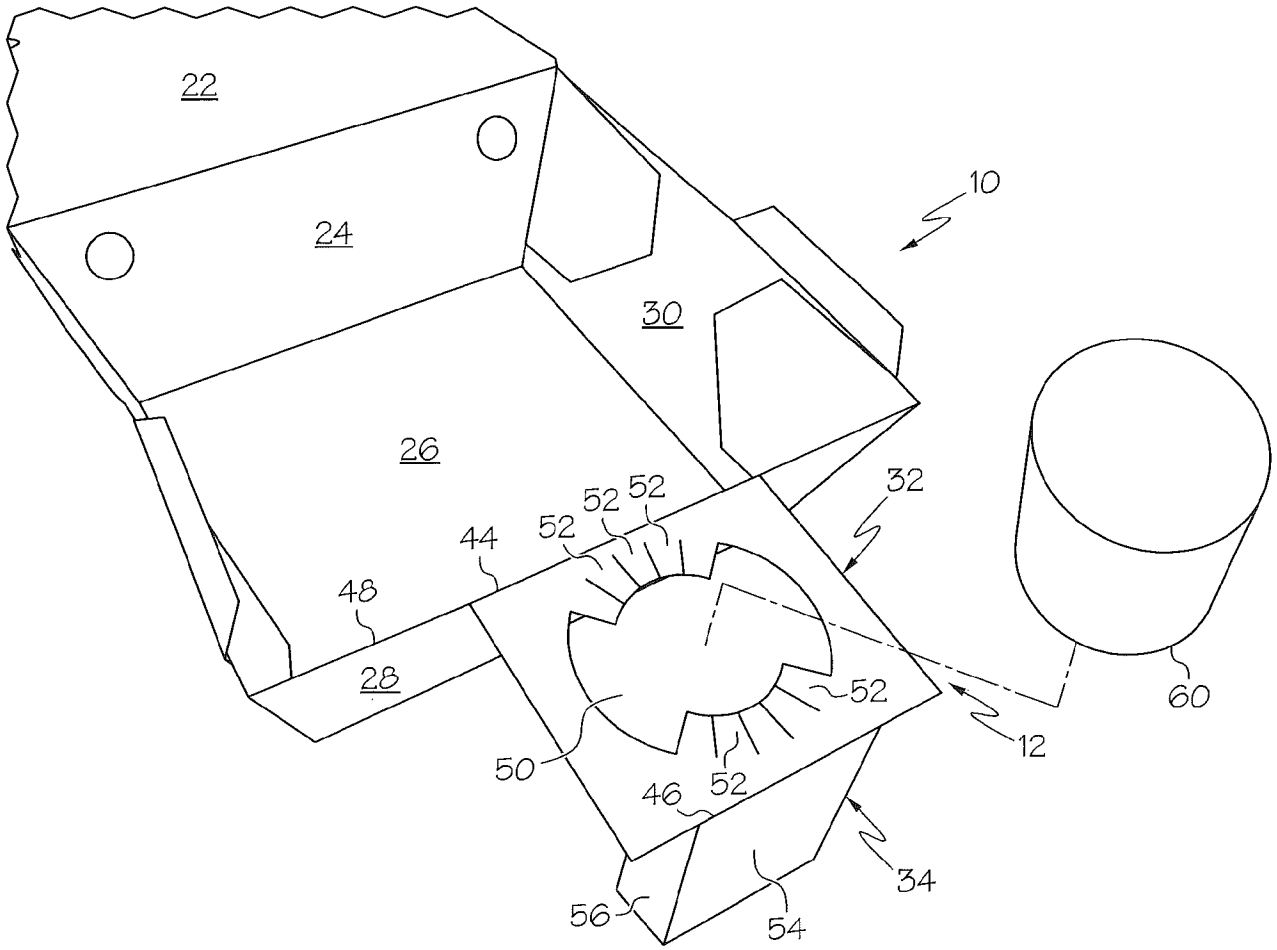
FIG. 6 is a partial top perspective view of the configured carton of FIG. 3 illustrating the condiment container holder in an outwardly-extended serving position outside the carton in accordance with one embodiment of the present invention.

Support leg 34 supports holding section 32 when the condiment container holder 12 is in the open or extended position as shown in FIGS. 5 and 6. As shown in FIG. 1, support leg 34 is connected to the second end 46 of holding section 32 by a hinge, such as a fold line or score line. This hinge connection may span the entire width of support leg 34, or in the alternative, may span only a partial width of support leg 34 so long as support leg 34 is at least partially connected to holding section 32. When condiment container holder 12 is in the open or extended position, support leg 34 extends generally downward from the second end 46 of holding section 32 in order to allow holding section 32 to remain in a generally horizontal position. When condiment container holder 12 is located within carton 10, the lower edge of support leg 32 can rest on the bottom panel 26. When condiment container holder 12 is located outside of carton 10, the lower edge of support leg 32 can rest on a surface apart of the container, such as a table or vehicle console. The width of support leg 34 may extend the entire length of the second end 46 of holding section 32 such that the edges of support leg 34 are flush with the edges of holding section 32. However, support leg 34 may also have a width greater than or less than holding section 32.

In one embodiment, support leg 34 comprises a center web 54 and flanges 56 on either side of center web 54. The flanges 56 may be folded either forward or backward relative to center web 54 along a support leg flange hinge 58, such as a fold line, in order to provide additional rigidity to the condiment container holder 12 when it is in the extended position. In one possible arrangement, flange 56 may be folded inwardly or outwardly along support leg flange hinge 58 such that it forms roughly an angle 90-degree angle with respect to the center web 54. In another possible arrangement, flange 56 may also be folded inwardly or outwardly at roughly 45 degrees such that it is not perpendicular to center web 54 as shown in FIG. 2. In a preferred arrangement, flange 56 is capable of being folded at any angle ranging between about 45 degrees and about 315 degrees with respect to the center web. FIGS. 5 and 6 show flanges 56 folded inward underneath the holding section 12. In this embodiment, the flanges 56 would not be connected to the second end 46 of holding section 32 in order to allow for the flanges to fold either forward or backward.

Condiment container holder 12 may also contain multiple support legs. As an alternative to having one support leg 34 attached to the second end 46 of holding section 32, holding section 32 may have support legs attached to any or all of its free ends. In one embodiment, holding section 32 has a support leg 34 attached to each end adjacent to its first end 44. Each support leg 32 may comprise of a center web 54 and adjacent flanges 56, or each support leg may comprise of only a center web 54. In another embodiment, holding section 32 has a support leg 34 attached to all three of its free ends. In either embodiment, each support leg 34 is connected to one of the ends of holding section 32 by a hinge connection, such as a fold line or score line. This hinge connection may extend all or part of the length of the corresponding end of the holding section 32. The hinge connection allows each support leg 34 to be folded flat against holding section 32 when condiment container 12 is in the collapsed position.

Support leg 34 may also include a tab (not shown) at its lower terminal end such that it may be inserted into a corresponding slot (not shown) within the bottom panel 26 in order to more securely hold condiment container 12 in place. In one embodiment, the center web 54 contains a tab extending from the terminal end of support leg 34 that is capable of being inserted in corresponding slot or slit located on the bottom panel 26 directly beneath the second end 46 of holding section 32 when condiment container 12 is in the extended position. In another embodiment, when condiment container 12 is positioned such that it is adjacent to one of the corners of base portion 14, support leg 34 may optionally include a foldable tab extending from its side edge that can be inserted into a corresponding sidewall slot located on the carton sidewall in order to more securely hold condiment container holder 12 in its extended or open position.

Figure 4:
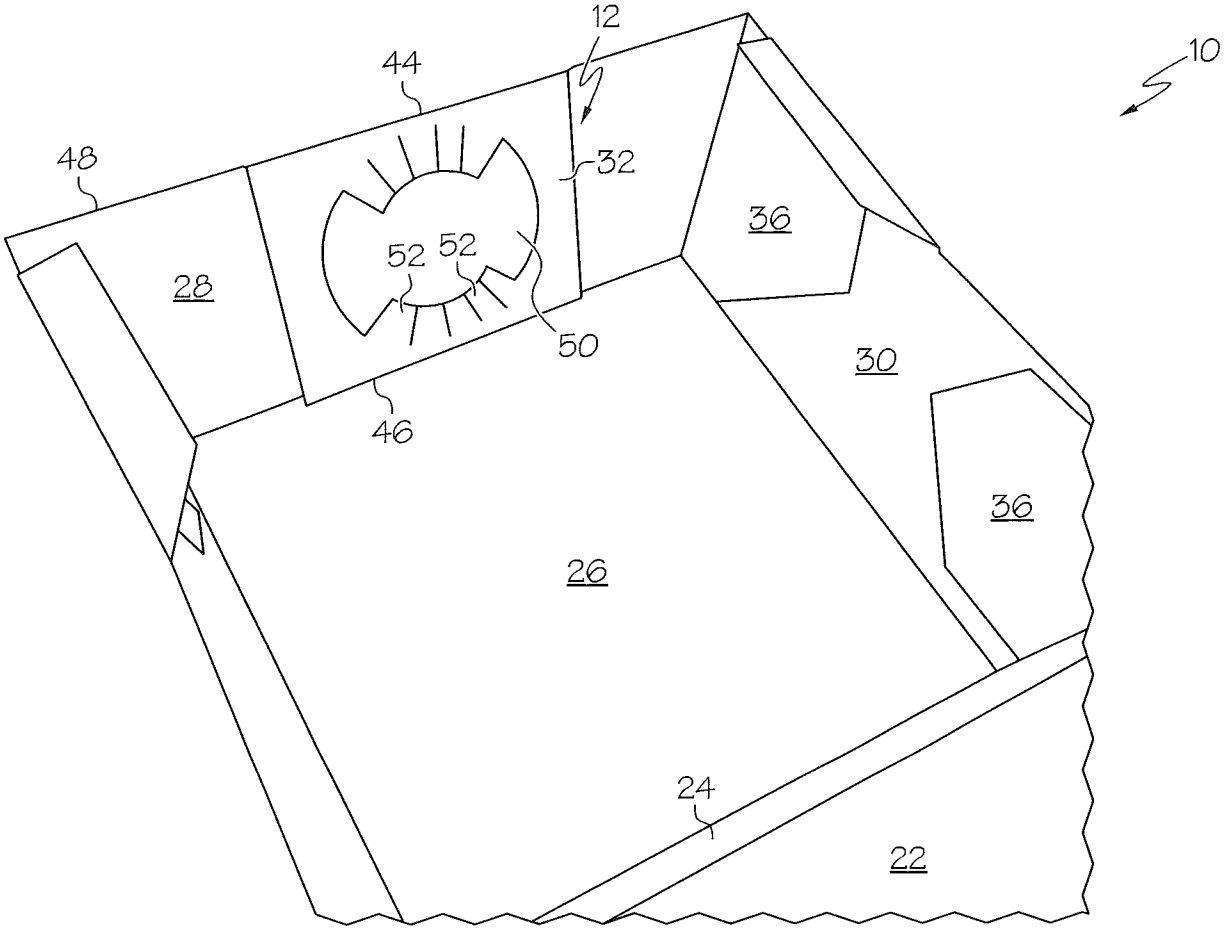
FIG. 4 is a partial top perspective view of the configured carton of FIG. 3 illustrating the condiment container holder in a collapsed position in accordance with one embodiment of the present invention

When condiment container holder 12 is in the closed or collapsed position it can be folded flat against the carton sidewall so as to not block access to any of the carton's contents. In the closed position, support leg 34 is folded flat against holding section 32 along the second end 46 of holding section 32. Holding section 32 is then folded flat against the carton sidewall along the connection between the first end 44 of holding section 32 and the carton sidewall's upper edge. When in the closed position, support leg 34 is adjacent to the carton sidewall and holding section 32 is adjacent support leg 34. It is also possible for support leg 34 to be folded outwardly along second end 46 of holding section 32 such that holding section 32 lies flat against the carton sidewall and support leg 34 lies flat against holding section 32 when in the closed position. FIG. 4 shows condiment container holder 12 in its closed position where support leg 34 is folded inwardly along holding section's 32 second end 46 and holding section 32 is folded along its first end 44 and upper edge 48 of front panel 28 such that front panel 28, support leg 34, and holding section 32 lie flat against one another.

To accomplish this folding, support leg 34 has a length $L_S$ that is slightly less than the length $L_H$ of holding section 32. The length $L_H$ of holding section 32 in turn is approximately equal to or slightly less than the height $H_F$ of the carton sidewall. FIGS. 1 and 4 show one embodiment where the length $L_S$ of support leg 34 is slightly less than the length $L_H$ of holding section 32, which is in turn slightly less than the length $H_F$ of front panel 28 such that support leg 34 and holding section 32 are folded substantially flat against front panel 28. In an alternative embodiment, the length $L_H$ of holding section 32 is slightly greater than the height $H_F$ of the carton sidewall such that the holding section 32 may provide a very slight interference fit in order to retain the condiment container holder 12 in its folded position.

It is also anticipated that support leg 34 may be comprised of multiple foldably connected sections such as a center web and a bottom flange that rests on the bottom panel of carton 10 when the condiment container holder is in the extended position. In such an embodiment, the total length $L_S$ of support leg 34 may be greater than the length $L_H$ of holding section 34 as long as the individual lengths of the foldably connected sections of support leg 34 do not exceed the length $L_H$ of holding section 34.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A food carton suitable for holding food items and a condiment container, said carton comprising:

a carton bottom panel;

a carton sidewall with an upper edge; and a condiment container holder comprising:

a condiment container holding section having first and second ends, wherein said first end is connected to said upper edge of said carton sidewall by a first hinge; and a support leg connected to said second end of said condiment container holding section by a second hinge;

wherein while said food carton is configured, said condiment container holder is selectively movable between a collapsed position and an extended position by rotating said condiment container holder about said first hinge;

wherein said condiment container holding section extends generally horizontally from said upper edge of said carton sidewall and said support leg extends generally downward from said end of said condiment container holding section when said condiment container holder is in said extended position;

wherein said condiment container holding section is folded at said first hinge substantially flat relative to said carton sidewall when said condiment container holder is in said collapsed position.

2. The food carton of claim 1, wherein the carton sidewall and condiment container holder may be selectively folded such that the entire food carton is folded flat.

3. The food carton of claim 1, wherein said support leg at least partially rests on said carton bottom panel when said condiment container holder is in said extended position.

4. The food carton of claim 1, wherein said condiment container holding section extends generally horizontally away from said food carton and said support leg extends generally downward from said second end of said condiment container holding section outside of the food carton bottom panel when said condiment container holder is in said extended position.

5. The food carton of claim 1, wherein said support leg is folded at said second hinge substantially flat against said condiment container holding section when said condiment container holding section is in a collapsed position.

6. The food carton of claim 1, wherein a length of said condiment container holding section is not greater than a height of said carton sidewall.

7. The food carton of claim 6, wherein a length of said support leg is not greater than said length of said condiment container holding section.

8. The food carton of claim 1, wherein said condiment container holding section includes an opening defined therethrough for receiving said condiment container.

9. The food carton of claim 8, wherein said condiment container holding section includes one or more tabs extending inwardly from a periphery of said opening, said tabs at least partially gripping a sidewall of said condiment container when said condiment container is inserted into said opening.

10. The food carton of claim 9, wherein said one or more tabs bend in a downward direction when said condiment container is placed in said opening of said condiment container holding section.

11. The food carton of claim 1, wherein said support leg includes a center web and at least one flange connected to said center web by a support leg flange hinge perpendicular to said second hinge.

12. The food carton of claim 11, wherein said at least one flange is folded at said support leg flange hinge at an angle that ranges from about 45 degrees to about 315 degrees with respect to said center web when said condiment container holding section is extended generally horizontally from said upper edge of said carton sidewall and said support leg is extended from said second end of said condiment container sidewall.

13. The food carton of claim 1, wherein said support leg includes an unaffixed lower terminal end.

14. A foldable food carton suitable for holding food items and a condiment container comprising:

a sidewall having an upper edge, said sidewall partially defining an interior of said food carton;

a condiment container holding section having first and second ends, said first end of said condiment container holding section at least partially attached to said upper edge of said sidewall by a first hinge;

an opening defined through said condiment container holding section for receiving said condiment container;

at least one tab extending inwardly from a periphery of said opening, said at least one tab capable of being downward and engaging said condiment container when said condiment container is inserted in said opening; and a support leg comprising a center web and at least one support flange, said support leg at least partially attached to said second end of said condiment container holding section by a second hinge;

wherein while said food carton is configured, said condiment container holding section is collapsible so as to not block any access to said interior of said food carton.

15. The foldable food carton of claim 14, wherein said condiment container holding section extends generally horizontally from said upper edge of said carton sidewall and said support leg extends generally vertically from said second end of said condiment container holding section when said condiment container holding section is in an extended position.

16. The foldable food carton of claim 15, wherein said support leg is folded at said second hinge substantially flat against said condiment container holding section, and said condiment container holding section folded at said first hinge substantially flat against said carton sidewall when said condiment container holding section is in a collapsed position.

17. The foldable food carton of claim 16, wherein said condiment container holding section and said support leg comprise a condiment container holder, and wherein said condiment container holder is attached to said foldable food carton only at said first hinge so that condiment container holding section is selectively rotatably moveable between said extended position and said collapsed position after said foldable food carton is configured.

18. The foldable food carton of claim 14, wherein a length of said support leg is not greater than said length of said condiment container holding section.

19. A foldable blank for forming a food carton suitable for holding food items and a condiment container, said blank comprising:

a sidewall having an upper end;

a condiment container holding section having first and second ends, wherein said first end of said condiment container holding section is hingedly attached to said upper end of said sidewall; and a support leg hingedly attached to said second end of said condiment container holding section;

wherein a length of said condiment container holding section is not greater than a height of said sidewall;

wherein said condiment container holding section is selectively movable into a collapsed position while said foldable blank is configured into said food carton.

* * * * *